US007540161B2

(12) United States Patent
Broadbent et al.

(10) Patent No.: US 7,540,161 B2
(45) Date of Patent: Jun. 2, 2009

(54) ICE MAKING MACHINE, METHOD AND EVAPORATOR ASSEMBLIES

(75) Inventors: John Allen Broadbent, Centennial, CO (US); Matthew W. Allison, Mundelein, IL (US)

(73) Assignee: Mile High Equipment LLC, Denver, CO (US)

( * ) Notice: Subject to any disclaimer, the term of this patent is extended or adjusted under 35 U.S.C. 154(b) by 74 days.

(21) Appl. No.: 11/542,813

(22) Filed: Oct. 4, 2006

(65) Prior Publication Data

US 2007/0130983 A1 Jun. 14, 2007

Related U.S. Application Data

(60) Provisional application No. 60/723,846, filed on Oct. 5, 2005, provisional application No. 60/724,155, filed on Oct. 6, 2005, provisional application No. 60/724,153, filed on Oct. 6, 2005, provisional application No. 60/724,218, filed on Oct. 6, 2005, provisional application No. 60/724,252, filed on Oct. 6, 2005, provisional application No. 60/724,154, filed on Oct. 6, 2005, provisional application No. 60/724,256, filed on Oct. 6, 2005, provisional application No. 60/735,417, filed on Nov. 10, 2005.

(51) Int. Cl.
*F25C 5/08* (2006.01)

(52) U.S. Cl. ..... 62/73; 62/351

(58) Field of Classification Search ..... 62/66–74, 62/340–356

See application file for complete search history.

(56) References Cited

U.S. PATENT DOCUMENTS

| | | | | |
|---|---|---|---|---|
| 2,995,017 | A * | 8/1961 | Breeding | 62/157 |
| 3,220,205 | A * | 11/1965 | Breeding | 62/73 |
| 4,922,723 | A * | 5/1990 | Broadbent | 62/72 |
| 6,247,318 | B1 | 6/2001 | Stensrud et al. | 62/74 |
| 6,870,139 | B2 * | 3/2005 | Petrenko | 219/482 |
| 2004/0149734 | A1 * | 8/2004 | Petrenko et al. | 219/538 |
| 2006/0288726 | A1 * | 12/2006 | Mori et al. | 62/351 |

* cited by examiner

*Primary Examiner*—William E Tapolcai
(74) *Attorney, Agent, or Firm*—Ohlandt, Greeley, Ruggiero & Perle, L.L.P.

(57) ABSTRACT

Ice making machine that uses PETD harvest technology, evaporators, ice molds and cooling system. One evaporator makes thin layers of ice that are laminated to form a larger ice piece. Other evaporators include an ice forming surface on a material that has good thermal conductivity for forming ice in a freeze mode and good electrical conductivity to serve as a resistive heater during a harvest mode. One evaporator has a plate and an array of freezing sites that extend above a surface thereof. Another evaporator has a plate that is divided into strips of good and poor thermal conductivity by. Another evaporator has a refrigerant tube that is sandwiched between a pair of corrugated sheets that have ice forming surfaces. Another evaporator has a waffle style pan that is constructed of a dielectric layer sandwiched between a pair of copper layers. Another evaporator forms an ice slab on an inclined flat surface, which after harvest is diced into cubes with a wire grid. A cooling system uses an evaporator to provide a cooling air to an ice mold to form ice and uses PETD energy to harvest the ice and defrost the evaporator.

21 Claims, 7 Drawing Sheets

ICE MAKING MACHINE, METHOD AND EVAPORATOR ASSEMBLIES

RELATED APPLICATION

This application claims the benefit of U.S. Provisional Patent Application, Ser. No. 60/723,846, filed Oct. 5, 2005, the entire contents of which are hereby incorporated by reference, U.S. Provisional Patent Application, Ser. No. 60/724,155, filed Oct. 6, 2005, the entire contents of which are hereby incorporated by reference, U.S. Provisional Patent Application, Ser. No. 60/724,153, filed Oct. 6, 2005, the entire contents of which are hereby incorporated by reference, U.S. Provisional Patent Application, Ser. No. 60/724,218, filed Oct. 6, 2005, the entire contents of which are hereby incorporated by reference, U.S. Provisional Patent Application, Ser. No. 60/724,252, filed Oct. 6, 2005, the entire contents of which are hereby incorporated by reference, U.S. Provisional Patent Application, Ser. No. 60/724,154, filed Oct. 6, 2005, the entire contents of which are hereby incorporated by reference, U.S. Provisional Patent Application, Ser. No. 60/724,256, filed Oct. 6, 2005, the entire contents of which are hereby incorporated by reference, and U.S. Provisional Patent Application. Ser. No. 60/735,417, filed Nov. 10, 2005, the entire contents of which are hereby incorporated by reference.

FIELD OF THE INVENTION

This invention relates to an ice making machine and a method that use electrical energy, e.g., PETD, to harvest ice and to various evaporators, ice molds and cooling systems of the ice making machine.

BACKGROUND OF THE INVENTION

Conventional ice makers have an ice making compartment located in proximity to, for example above, an ice storage compartment. Ice is made during an ice making mode in the ice making compartment. The ice is transferred by gravity action to the ice storage compartment during an ice harvest mode.

The ice making compartment includes an evaporator that is operable during the ice making mode to make ice cubes.

Conventional evaporators include an array of ice cells, an evaporator tube and a water drip tube. Typically, the evaporator tube is connected to a compressor and condenser assembly and the water drip tube is connected to a water supply system all of which are conventional for ice makers (see U.S. Pat. No. 6,247,318, which is incorporated herein in its entirety).

The ice cells of the array are preferably arranged in a grid or matrix configuration having a plurality of horizontal rows and a plurality of vertical columns. Optionally, disposed directly behind the array is another array of ice cells, which is a mirror image of the first array. The pair of arrays are formed by a plurality of integral vertical structures that are interleaved with a plurality of vertical partitions. Thus, a vertical column is formed with an integral vertical structure and two vertical partitions that are disposed on either side thereof.

During the ice making mode, refrigerant is circulated through the evaporator tube to cool the ice cells. Water drips from the drip tube into the ice cell arrays. The dripping water trickles through the arrays and freezes to gradually develop an ice cube in each ice cell. During the harvest mode, refrigerant from the discharge side of the system is circulated in the evaporator tube. This results in a slight melting of each ice cube that allows the ice cube to loosen from its ice cell and fall into the storage compartment or bin.

This prior art method of harvesting the ice represents a loss in ice making efficiency due to: (a.) the amount of ice that is melted during the harvesting operation caused by the excess heat provided by both the hot gas in the evaporator and the warm water introduced, (b) the time it takes to perform the harvest operation—such time not being available to make ice, and (c) the excess heating of the evaporator—such heat having to be removed from the evaporator during the subsequent ice making mode.

Hence, there is a strong demand for an ice making machine which avoids the aforementioned deficiency and provides an ice making machine whereby the ice formed in ice making cells can be removed quickly and efficiently minimizing excess meltage of the ice, removing the ice more quickly than is possible with a hot gas defrost, and avoiding any excess heating of evaporator or ice making cells.

SUMMARY OF THE INVENTION

An ice making machine of the present invention comprises a water supply, a cooling system, an electrical energy source and an evaporator assembly. The evaporator assembly comprises at least one thermally conductive surface disposed in thermal transfer with an electrically conductive and thermally conductive layer, which is connected in circuit with the electrical energy source. A controller during a freeze mode operates the water supply and the cooling system to form ice on the electrically conductive and thermally conductive layer and during a harvest mode operates the electrical energy source to apply electrical pulse energy to the electrically conductive and thermally conductive layer to melt an interfacial layer of the ice such that it is freed from the layer.

In some embodiments, the electrically conductive and thermally conductive layer is made of a material selected from the group consisting of: aluminum, steel and plastic.

In some embodiments, the electrically conductive and thermally conductive layer may be a foil.

In another embodiment of the ice making machine of the present invention, the thermally conductive surface is part of an array of thermally conductive surfaces.

In another embodiment of the ice making machine of the present invention the freed ice comprises a plurality of thin ice layers. The evaporator assembly further comprises a laminator that combines the ice layers into a laminated ice piece.

In another embodiment of the ice making machine of the present invention the evaporator assembly further comprises a base portion that includes the array of thermally conductive surfaces. The thermally conductive surfaces are separated from one another by spaces over which ice is not formed during the freeze mode.

In another embodiment of the ice making machine of the present invention the spaces are occupied by a substance selected from the group consisting of: air and a thermally insulating material.

In another embodiment of the ice making machine of the present invention the base portion comprises a plate that includes a plurality of raised portions that extend in rows across the plate and at least one layer of poor thermal conductivity that extends over the rows to occupy the spaces.

In another embodiment of the ice making machine of the present invention the raised portions comprise raised freeze sites that form the array of surfaces.

In another embodiment of the ice making machine of the present invention the array of thermally conductive surfaces is disposed on triangular shaped regions of the raised portions.

In another embodiment of the ice making machine of the present invention the evaporator assembly further comprises a base portion that includes a plurality of corrugations interleaved with flat portions that form the array of thermally conductive surfaces.

In another embodiment of the ice making machine of the present invention a layer of dielectric material is disposed between the base portion and the electrically conductive and thermally conductive layer.

In another embodiment of the ice making machine of the present invention the base portion is configured as a pan.

In another embodiment of the ice making machine of the present invention the thermally conductive surface is substantially flat. The ice is formed as a slab. The freed slab of ice is partitioned into smaller pieces of ice.

In another embodiment of the ice making machine of the present invention the evaporator assembly further comprises a wire grid that is used to partition the freed slab of ice into the pieces of ice.

In another embodiment of the ice making machine of the present invention the cooling system is selected from the group consisting of: refrigerant and cool air.

In another embodiment of the ice making machine of the present invention the cooling system comprises a blower, a refrigerant supply, and an evaporator. The controller during the freeze mode operates the blower to provide an air stream that flows to the evaporator assembly and operates the refrigerant supply and the evaporator to cool the air stream to a temperature that causes the ice to form on the electrically conductive and thermally conductive layer.

In another embodiment, the ice making machine of the present invention comprises a water supply, an ice mold and a cooling system that comprises a blower, a refrigerant supply, and an evaporator. A controller during a freeze mode operates the water supply and the cooling system to form ice on a surface of the ice mold by operating the blower to provide an air stream that flows to the ice mold and operates the refrigerant supply and the evaporator to cool the air stream to a temperature that causes water from the water supply to form ice on the surface of the ice mold.

In another embodiment of the ice making machine of the present invention the controller during a harvest mode operates an electrical energy source to provide electrical pulse energy to heat the ice mold so as to melt an interfacial layer of the ice such that it is freed from the surface of the ice mold.

In another embodiment of the ice making machine of the present invention the controller defrosts the evaporator by operating the electrical energy source to provide electrical pulse energy to heat the evaporator.

An evaporator assembly of the present invention comprises at least one thermally conductive surface disposed in thermal transfer with an electrically conductive and thermally conductive layer and at least one electrical connection affixed to the electrically conductive and thermally conductive layer.

In another embodiment of the evaporator assembly of the present invention, the electrically conductive and thermally conductive layer is made of a material selected from the group consisting of: aluminum, steel and plastic.

In another embodiment of the evaporator assembly of the present invention the electrically conductive and thermally conductive layer is a foil.

In another embodiment of the evaporator assembly of the present invention the thermally conductive surface is part of an array of thermally conductive surfaces.

In another embodiment of the evaporator assembly of the present invention the ice, when freed of the surfaces, comprises a plurality of thin ice layers. A laminator combines the ice layers into a laminated ice piece.

In another embodiment of the evaporator assembly of the present invention a base portion includes the array of thermally conductive surfaces. The thermally conductive surfaces are separated from one another by spaces over which ice is not formed during a freeze mode.

In another embodiment of the evaporator assembly of the present invention the spaces are occupied by a substance selected from the group consisting of: air and a thermally insulating material.

In another embodiment of the evaporator assembly of the present invention the base portion comprises a plate that includes a plurality of raised portions that extend in rows across the plate and at least one layer of poor thermal conductivity that extends over the rows to occupy the spaces.

In another embodiment of the evaporator assembly of the present invention the raised portions comprise raised freeze sites that form the array of surfaces.

In another embodiment of the evaporator assembly of the present invention the array of thermally conductive surfaces is disposed on triangular shaped regions of the raised portions.

In another embodiment of the evaporator assembly of the present invention a base portion includes a plurality of corrugations interleaved with flat portions that comprise the array of thermally conductive surfaces.

In another embodiment of the evaporator assembly of the present invention a layer of dielectric material is disposed between the base portion and the electrically conductive and thermally conductive layer.

In another embodiment of the evaporator assembly of the present invention the array of thermally conductive surfaces is configured in a pan.

In another embodiment of the evaporator assembly of the present invention the thermally conductive surface is substantially flat and ice formed thereon is a slab.

In another embodiment of the evaporator assembly of the present invention a wire grid that partitions the slab of ice, when freed from the electrically conductive and thermally conductive layer, into smaller pieces of ice.

In another embodiment of the evaporator assembly of the present invention, a plate comprises a plurality of raised portions that extend in rows across the plate. At least one layer of poor thermal conductivity extends over the rows and is shaped to partition each of the rows into a plurality of freeze sites. At least one electrical connection affixed to the plate.

In another embodiment of the evaporator assembly of the present invention at least one refrigerant passage disposed in the plate.

In another embodiment of the evaporator assembly of the present invention a plate comprises a plurality of corrugations interleaved with flat portions that are bonded to a refrigerant tube. At least one electrical connection affixed to the plate.

In another embodiment of the evaporator assembly of the present invention the corrugations and flat portions are disposed vertically.

In another embodiment of the evaporator assembly of the present invention the plate is constructed of a layer of dielectric material sandwiched between first and second metallic layers.

In another embodiment of the evaporator assembly of the present invention a metallic pan has a plurality of rows of freeze sites and a refrigerant tube is disposed in thermal contact with the freeze sites. At least one electrical connection affixed to the pan.

In another embodiment of the evaporator assembly of the present invention the pan is a composite constructed of a dielectric layer sandwiched between first and second metallic layers.

In another embodiment of the evaporator assembly of the present invention the composite is coated with nickel.

In another embodiment of the evaporator assembly of the present invention a substantially flat electrically conductive and thermally conductive plate that has a substantially flat surface that is slightly inclined with a downward slope. At least one electrical connection affixed to the pan.

In another embodiment of the evaporator assembly of the present invention a wire grid is disposed to collect a slab of ice freed from the surface during a harvest mode and to partition the slab of ice into smaller pieces of ice.

A method of the present invention makes ice with an ice making machine that comprises an evaporator assembly that includes at least one thermally conductive surface in thermal transfer with an electrically conductive and thermally conductive layer, a water supply, a cooling system and an electrical energy source. The method during a freeze mode operates the water supply and the cooling system to form ice on the electrically conductive and thermally conductive layer. The method also during a harvest mode operates the electrical energy source to apply electrical pulse energy to the electrically conductive and thermally conductive layer to melt an interfacial layer of the ice such that it is free from the electrically conductive and thermally conductive layer.

In another embodiment of the method of the present invention, the freed ice comprises a plurality of thin ice layers, which are laminated into a laminated ice piece.

In another embodiment of the method of the present invention the thermally conductive surface is part of an array of thermally conductive surfaces in thermal transfer with the electrically conductive and thermally conductive layer. The evaporator assembly further includes a plate that includes a plurality of raised portions that extend in rows across the plate and at least one layer of poor thermal conductivity that extends over the rows to partition the rows into the array of thermally conductive surfaces.

In another embodiment of the method of the present invention the evaporator assembly comprises a plate that includes a plurality of corrugations interleaved with flat portions that form the array of thermally conductive surfaces.

In another embodiment of the method of the present invention the thermally conductive surface is part of an array of thermally conductive surfaces in thermal transfer with the electrically conductive and thermally conductive layer and the evaporator assembly further comprises a pan.

In another embodiment of the method of the present invention the thermally conductive surface is substantially flat and ice formed thereon is a slab. The method partitions the slab of ice, when freed from the electrically conductive and thermally conductive layer, into a plurality of smaller pieces of ice.

In another embodiment of the method of the present invention the ice making machine comprises an ice mold, a water supply, and a cooling system that comprises a blower, a refrigerant supply and an evaporator. During a freeze mode the method operates the water supply and the cooling system to form ice on a surface of the ice mold by operating the blower to provide an air stream that flows to the ice mold and operates the refrigerant supply and the evaporator to cool the air stream to a temperature that causes water from the water supply to form ice on the surface of the ice mold.

In another embodiment of the method of the present invention the ice making machine further comprises an electrical energy source. The method during a harvest mode operates the electrical energy source to apply electrical pulse energy to the ice mold to melt an interfacial layer of the ice such that it is free from the surface of the ice mold.

In another embodiment of the method of the present invention, the ice making machine further comprises an electrical energy source. The method defrosts aid evaporator by operating the electrical energy source to provide electrical pulse energy to the evaporator.

BRIEF DESCRIPTION OF THE DRAWINGS

Other and further objects, advantages and features of the present invention will be understood by reference to the following specification in conjunction with the accompanying drawings, in which like reference characters denote like elements of structure and.

DESCRIPTION OF THE PREFERRED EMBODIMENT

The present disclosure encompasses the use of evaporator assemblies comprising ice forming surfaces, and a short-duration electrical resistance heater, e.g., pulse electric thermal deicing (PETD) to harvest ice formed on the ice forming surfaces. The short-duration electrical pulse is in the range between about 0.1 microsecond to 10 seconds, preferably between about 0.1 microsecond to 3 seconds, and most preferably between about 1 to 3 seconds. The shorter the electric pulse, the lower the energy input required to harvest the ice.

Preferably any refrigeration components are electrically isolated from the ice forming structures. According to the present disclosure, PETD energy is applied to an ice-forming structure in such a way as to not energize the entire ice making structure or other conductive refrigeration components which would otherwise require significant energy inputs or otherwise make the system unsafe from electrical shock.

Figure 1:
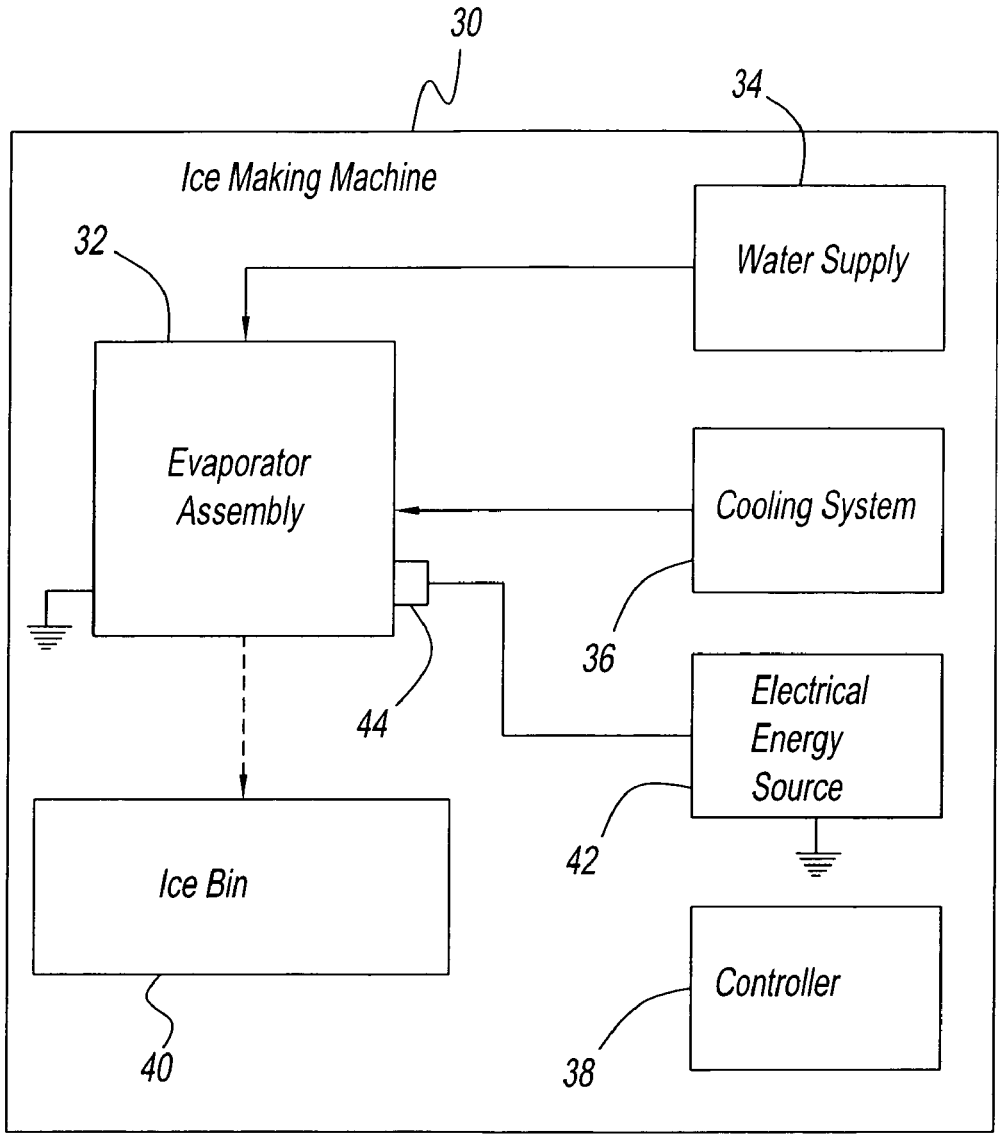
FIG. 1 is a block diagram of an ice making machine of the present invention.
Figure 2:
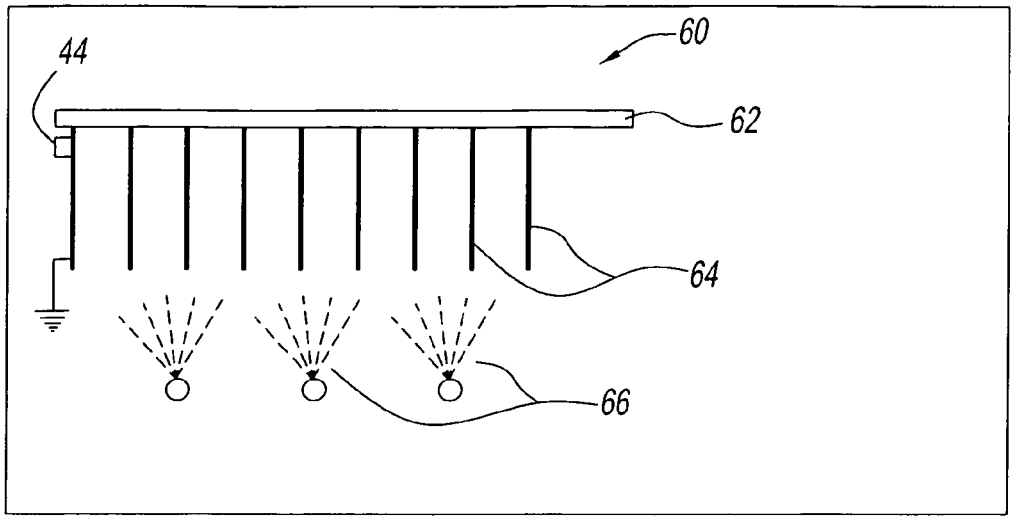
FIG. 2 depicts an embodiment of the evaporator assembly of the ice making system of FIG. 1.

Referring to FIG. 1, an ice making machine 30 comprises a thermally conductive evaporator assembly 32, a water supply 34, a cooling system 36, a controller 38, an ice bin 40 and an electrical energy source 42 comprising a source of pulsed electrical energy, e.g., PETD.

Cooling system 36 comprises a compressor, a condenser and a supply of refrigerant that circulates through an evaporator tube. In some embodiments, the evaporator tube is part of the evaporator assembly and is interconnected with the refrigerant supply. In other embodiments, the evaporator tube is used to cool a circulating air stream that cools the ice forming structures of the evaporator to form ice during the ice making or freezing mode. Water supply 34 includes a water valve (not shown). Controller 38 controls the freezing and harvesting modes by appropriately controlling the pulsed electrical energy, the flow of water and refrigerant or cooling air to evaporator assembly 32.

In accordance with the present disclosure, electrical energy source 42 is operable at the time of harvest to apply one or more short duration pulses of electric energy to the ice forming structures to melt an interfacial layer of the ice at the interface of the ice and the ice forming structures sufficiently to loosen the ice so that it falls by gravity for storage in ice bin 40. To this end, electrical energy source 42 is electrically interconnected with evaporator assembly 32 via a contact 44 and an electrical reference, such as circuit ground.

Electrical energy source 42 and the pulsed energy used for thermal de-icing, for example, may be of the type described in U.S. Pat. No. 6,870,139, U.S. Patent Publication No. 2005/0035110, and U.S. Patent Publication No. 2004/0149734, all of which are incorporated herein in their entirety by reference thereto, that is capable of supplying pulsed energy. Modulating the pulsed energy to the interface of the ice to the ice forming structure modifies a coefficient of friction between the ice and ice forming structure. The electrical pulse energy technology is known as Pulse Electro Thermal De-icing (PETD).

Typically, a pulse de-icer system heats an interface to a surface of an object so as to disrupt adhesion of ice with the surface. To reduce the energy requirement, one embodiment of a pulse de-icer explores a very low speed of heat propagation in non-metallic solid materials, including ice, and applies heating power to the interface for time sufficiently short for the heat to escape far from the interface zone; accordingly, most of the heat is used to heat and melt only a very thin layer of ice (hereinafter "interfacial ice"). The system preferably includes a power supply configured to generate a magnitude of power. In one aspect, the magnitude of the power has a substantially inverse-proportional relationship to a magnitude of energy used to melt ice at the interface. The pulse de-icer system may also include a controller configured to limit a duration in which the power supply generates the magnitude of the power. In one aspect, the duration has a substantially inverse-proportional relationship to a square of the magnitude of the power. The power supply may further include a switching power supply capable of pulsing voltage. The pulsed voltage may be supplied by a storage device, such as a battery or a capacitor. The battery or capacitor can, thus, be used to supply power to a heating element that is in thermal communication with the interface.

A preferred pulse de-icer systems is hereafter described. This pulse de-icer system may be used to remove ice from a surface of an object such as a ice forming cup or finger, typically by melting an interfacial layer of ice and/or modifying a coefficient of friction of an object-to-ice interface.

One such pulse de-icer system for modifying an interface between an evaporator assembly and ice according to the present disclosure comprises: a power supply, a controller, and a heating element. In one embodiment, the power supply is configured for generating power with a magnitude that is substantially inversely proportional to a magnitude of energy used to melt interfacial ice (hereinafter "interfacial ice") at the interface. A heating element is coupled to the power supply to convert the power into heat at the interface. Controller 38 is coupled to the power supply to limit a duration in which the heating element converts the power into heat. In one embodiment, the duration in which the heating element converts the power into heat at the interface is substantially inversely proportional to a square of the magnitude of the power.

Controller 38 controls electrical energy source 42 to apply electrical pulse energy when the ice has grown to the desired predetermined size. The electrical pulse energy causes electrical resistance heating of the ice by thermal conduction from ice the forming structure. The fast, even heating of the forming structure releases the ice within the forming structure more quickly than with the prior art defrost methods and minimizes the amount of melting that occurs.

From the foregoing it may be seen that the arrangement of the present disclosure provides an automatic ice making machine in which harvesting of the ice is achieved very quickly and in a very energy-efficient manner.

One embodiment of evaporator assembly 30 produces a plurality of thin layers of ice and laminates them together to form a laminated ice piece or cube. Because ice is a relatively poor conductor of heat, it is difficult to efficiently freeze thick ice cubes. Freezing ice in very thin layers is much more efficient than freezing thick layers and allows higher rates of heat transfer. Laminating thin layers of ice together to form a larger ice piece or cube allows higher efficiencies, higher rates of heat transfer (or conversely, a more compact ice making device) and a more desirable ice-form.

Figure 3:
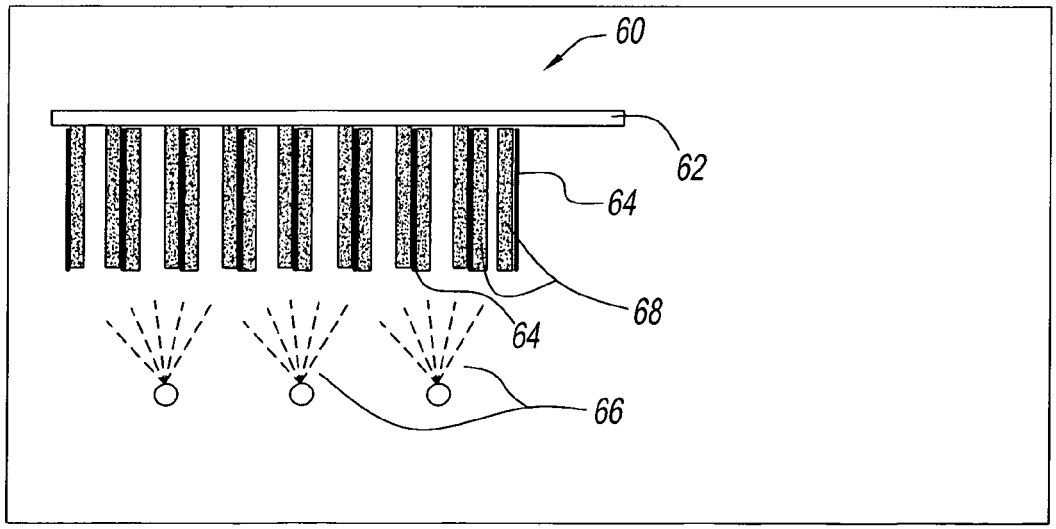
FIGS. 3-5 depict the operation of the evaporator assembly of FIG. 2.
Figure 4:
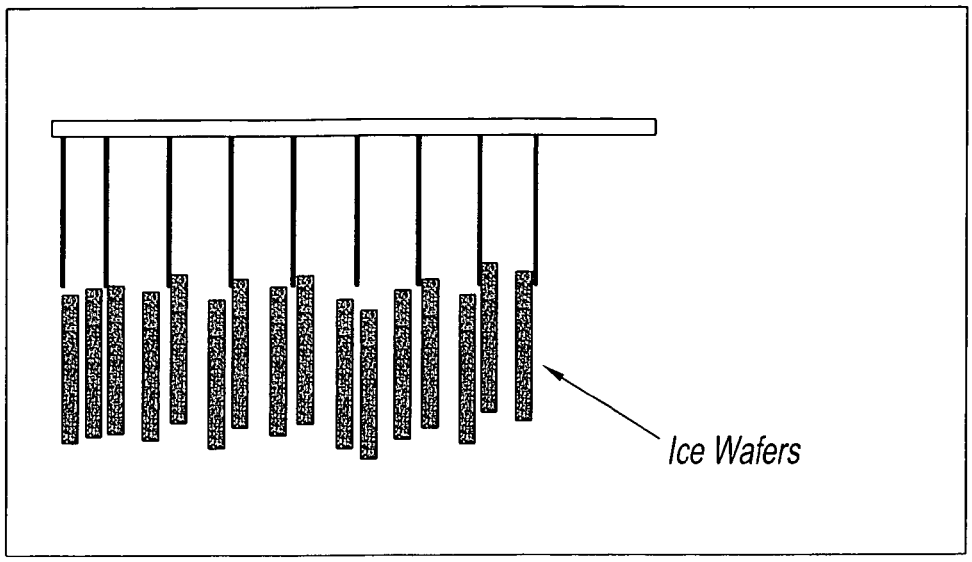

Referring to FIG. 2-5, this embodiment of evaporator assembly 30 comprises a thermally conductive ice forming structure 60 that includes a base portion 62 from which a plurality of flat ice forming or freezing surfaces 64 extend vertically downward. Controller 38 controls cooling system 36 using either a refrigerant tube or a cooling airflow during a freezing mode to cool base portion 62 and freezing surfaces 64 to a temperature suitable for forming a plurality of thin layers 68 of ice (e.g., below 0° C.). Controller 38 also during the freezing mode controls water supply 34 to provide water to a water distributor 66 that provides a spray of water to freezing surfaces 64. Controller 38 continues the freeze mode until thin layers of ice 68 form on freezing surfaces 64 as shown in FIG. 3.

Controller 38 then initiates a harvest mode by operating electrical energy source 42 to apply short duration electrical energy for electrical resistive heating of ice freezing surfaces 64. The electrical energy can be applied directly to ice forming surfaces 64 (contact 44 and circuit ground being at spaced apart points of ice forming surfaces 63) or to a separate electrical heating element disposed in close proximity to ice forming surfaces 64 (contact 44 and circuit ground being connected in circuit with the resistive heating element). For example, the resistive heating element may be of the type disclosed in co-pending U.S. patent application, Ser. No. 11/543,484, the entire contents of which are hereby incorporated by reference. The resistive heating element may also be a thin electrically conductive layer (e.g., a foil) shown in FIGS. 6-10. By way of example, contact 44 and circuit ground are shown for the left most ice forming surface 64, it being understood that each ice forming surface would also have a contact 44 and circuit ground.

Figure 5:
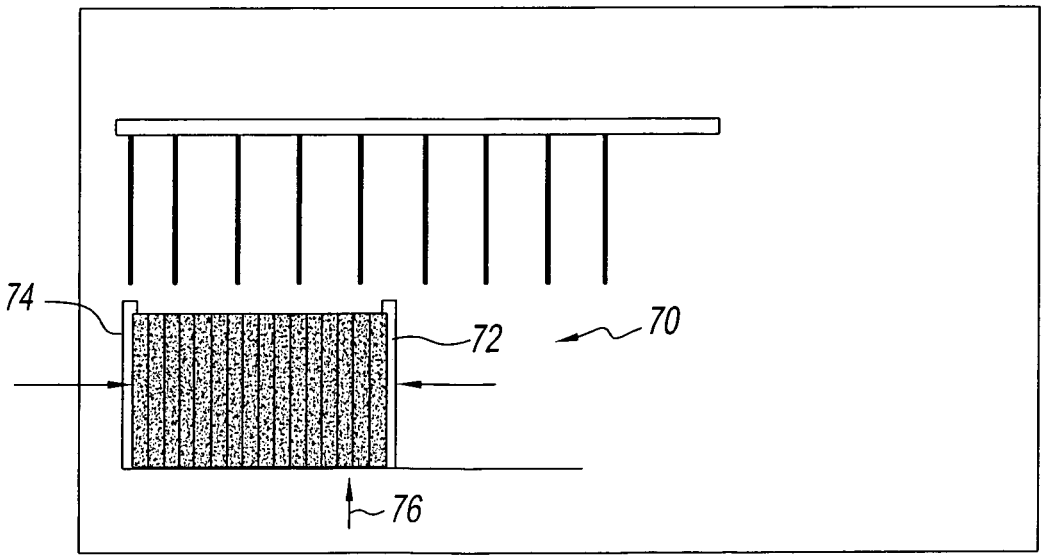

The heating of ice forming surfaces 64 causes thin ice layers 68 to melt free of and slide off ice forming surfaces 64 so as to fall into an ice laminator 70 (FIG. 5). Laminator 70 comprises laminator end pieces 72 and 74 that push the thin ice layers 68 together to form a laminated ice piece or cube 76. In one embodiment, laminator end pieces 72 and 74 are pushed toward one another. In another embodiment, laminator end piece 74 is stationary and only end piece 72 is pushed slid toward laminator end piece 74.

With the proper amount of sub-cooling prior to harvest and heating during harvest, the surfaces of ice layers 68 will be slightly wet, but their bulk will still be sub-cooled below 0° C. When pushed together in laminator 60, the moisture on the surfaces of thin ice layers 68 will cause thin ice layers 68 to refreeze into laminated cube 76.

Laminated cube 76 is then removed to ice bin 40 by any suitable mechanism. For example, opening laminator end pieces 72 and 74 and tipping the base of laminator 70 so that laminated cube 76 falls by gravity into ice bin 40.

Base portion 62 and ice forming surfaces 64 can be any material having a suitable thermal transfer characteristic for freezing ice. For example, base portion 62 and ice forming surfaces 64 may be a metal, such as aluminum, stainless steel, nickel and the like or a thermally conductive plastic.

Figure 7:
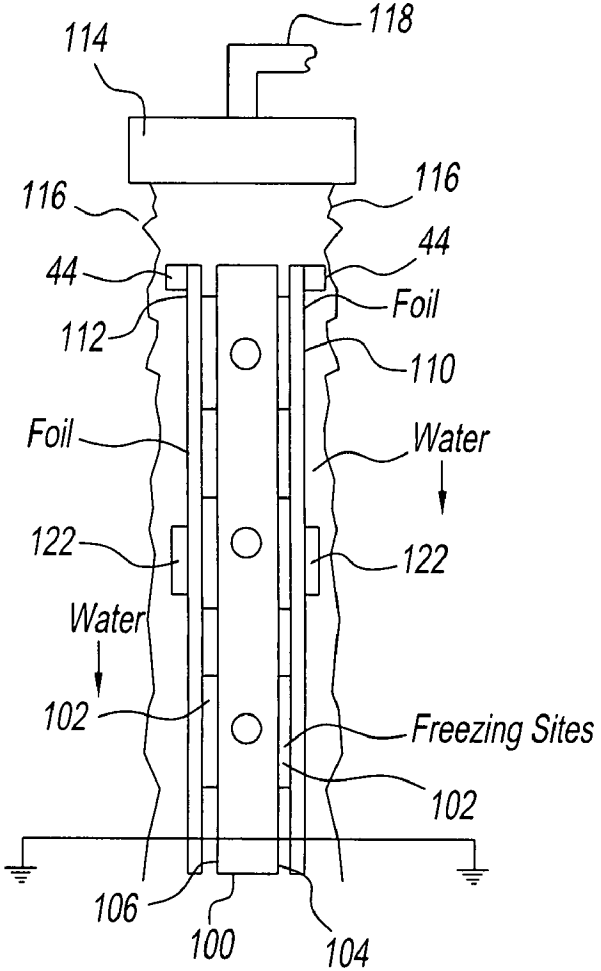
FIGS. 6 and 7 depict another embodiment of the evaporator assembly of the ice making system of FIG. 1.
Figure 6:
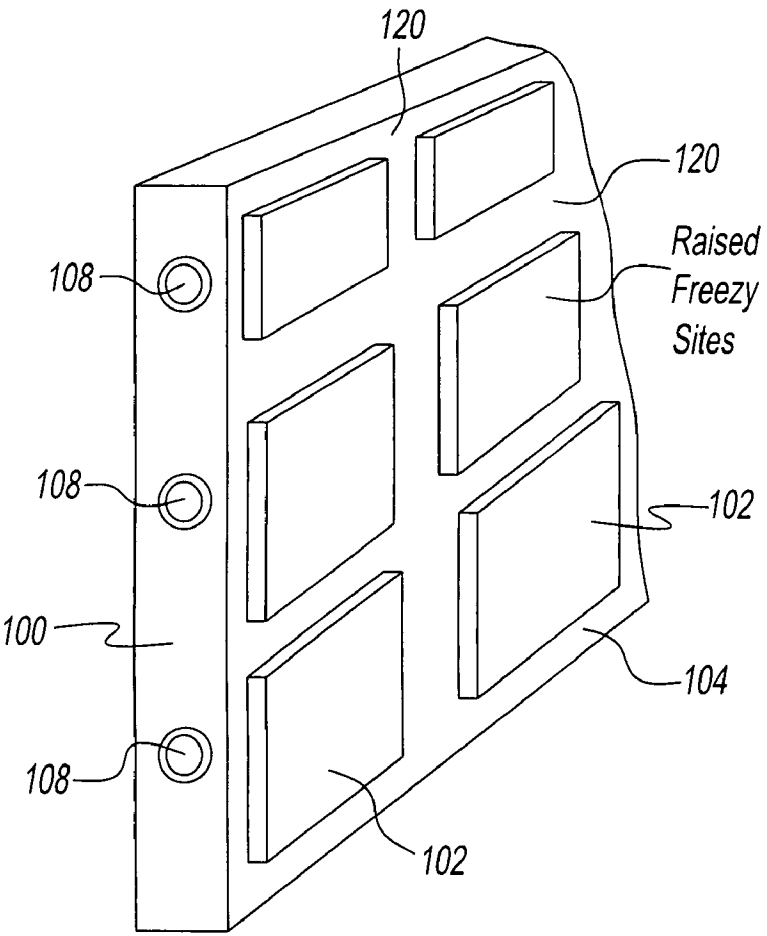

Referring to FIGS. 6 and 7, another embodiment of evaporator assembly 32 comprises a thermally conductive plate 100. An array (shown as a grid or matrix) of freezing sites 102 is disposed on a side surface 104 of plate 100. Another array of freezing sites 104 is disposed on an opposite side surface 106 of plate 100. In some embodiments, freezing sites 100 are disposed on only one side of plate 100. Freezing sites 100 project above a surface 104 of plate 100. A plurality of refrigerant passages 108 is disposed in plate 100. Passages 108 are connected by connectors (not shown) to cooling system 36 for circulation of a refrigerant. Optionally a refrigerant tube (not shown) could be disposed within passages 108 and connected with cooling system 36.

Thin electrically conductive layers (e.g., foils) 110 and 112 (shown only in FIG. 7) cover freezing sites 102 and surface 104 and surface 106, respectively, of plate 110. Foils 110 and 112 have a thermally conductivity suitable for ice making and an electrical conductivity suitable for conducting the short duration electrical duration pulses of electrical energy source 38. Foils 110 and 112 are shown in electrical contact with contact 44 and circuit ground. Foils 110 and 112 may comprise aluminum, stainless steel, Kapton® Polymide or other suitable material.

A water distributor 114 is disposed above plate 100 to supply a water flow 116 along the exterior surfaces of foils 110 and 112. Water distributor 114 is connected to water supply 34 via a conduit 118.

Spaces 120 (shown in FIG. 6) between freezing sites 102 are either air or any other suitable insulating material.

Controller 38 controls cooling system 36 to supply refrigerant to passages 108 during a freezing mode to cool plate 100 and freezing sites 102 foils 110 and 112 to a suitable temperature (below 0° C.) for forming ice pieces on foils 110 and 112. Controller 38 also during the freezing mode controls water supply 34 to provide water to water distributor 114 that provides water 116 that flows over the cooled foils 110 and 112. Controller 38 continues the freeze mode until ice pieces 122:form to a predetermined thickness on foils 110 and 112 adjacent or in registration with freezing sites 102.

Controller 38 then initiates a harvest mode by operating electrical energy source 42 to apply short duration electrical energy for electrical resistive heating of foils 110 and 112. The heating of foils 110 and 112 causes ice pieces 122 to melt free of foils 110 and 112 and to fall into ice bin 40.

Plate 100 and freezing sites 102 may be made with any material having a thermal conductivity suitable for making ice, such as aluminum, stainless steel or copper.

Figure 8:
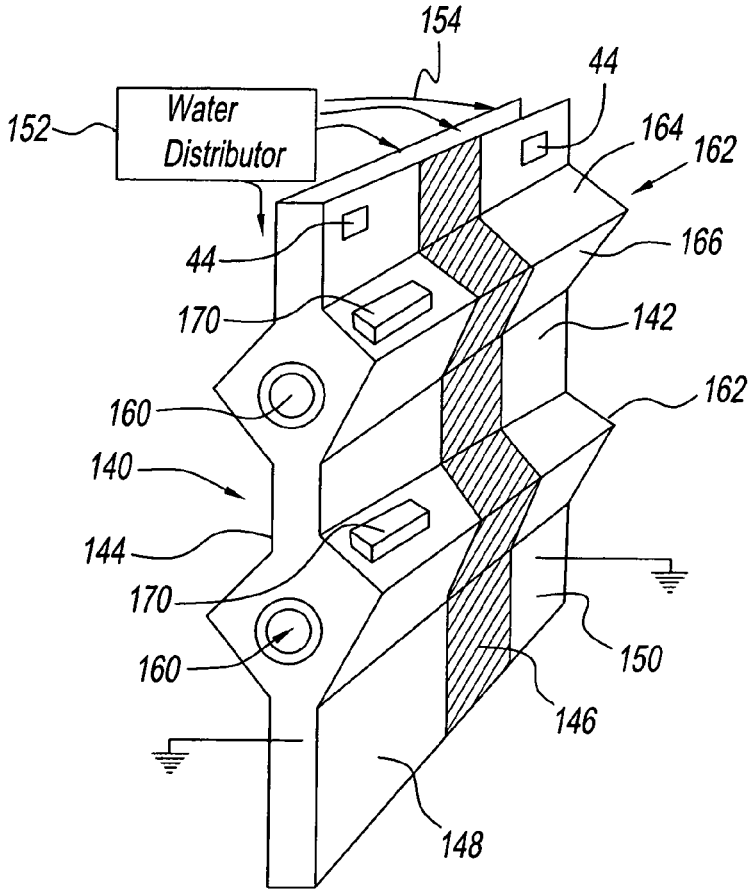
FIG. 8 depicts another embodiment of the evaporator assembly of the ice making system of FIG. 1.

Referring to FIG. 8, another embodiment of evaporator assembly 32 comprises a thermally conductive plate 140 having opposed surfaces 142 and 144. A strip 146 overlies surface 142. Strip 146 has poor thermal conductivity and is unsuitable for forming ice. Thus, strip 146 separates surface 142 into spaced apart strips 148 and 150 of good thermal conductivity suitable as ice forming surfaces. A similar strip 146 is affixed to surface 144 to divide surface 144 into spaced apart ice forming surfaces. A water distributor 152 connected to water supply 34 and is disposed above plate 140 to flow water 154 over surfaces 142 and 144.

A plurality of refrigerant passages 160 is disposed in plate 140. Passages 160 are connected by connectors (not shown) to cooling system 36 for circulation of a refrigerant. Optionally a refrigerant tube (not shown) could be disposed within passages 160 and connected with cooling system: 36.

Surfaces 142 and 144 are each shaped adjacent passages 160 to form horizontally disposed triangular shaped ridges 162 that have a downwardly disposed ramp 164 joined at an apex to an upwardly disposed ramp 166.

Controller 38 controls cooling system 36 to supply refrigerant to passages 108 during a freezing mode to cool plate 140 and freezing surface strips 148 and 150 to a suitable temperature (below 0° C.) for forming ice pieces thereon. Controller 38 also during the freezing mode controls water supply 34 to provide water to water distributor 152 that provides water 154 that flows over the cooled surfaces 142 and 144 of plate 100. Controller 38 continues the freeze mode until ice pieces 170 form on downwardly sloped ramps 162 of thermally conductive strips 148 and 150, but not on poor thermal conductivity strip 146.

Controller 38 then initiates a harvest mode by operating electrical energy source 42 to apply short duration electrical energy to conductive strips via contacts 44 and circuit ground. Optionally, surfaces 142 and 144 could each be covered with thin electrically conductive layers (e.g., metallic foils similar to foils 110 and 112) (FIG. 7). In this case ice pieces would be formed on the foils in registration with triangular shaped ridges 162 of thermally conductive strips 148 and 150 during the freezing mode. The PETD energy would be applied to the foils. In either case, the heating causes ice pieces 170 to melt free of triangular shaped ridges 162 of thermally conductive strips 148 and 150 (or foils) and to fall into ice bin 40.

Plate 140 can be oriented horizontally as shown or vertically. Plate 140 may be made with any material having a thermal conductivity suitable for making ice, such as aluminum, copper or thermally conductive plastic.

Figure 9:
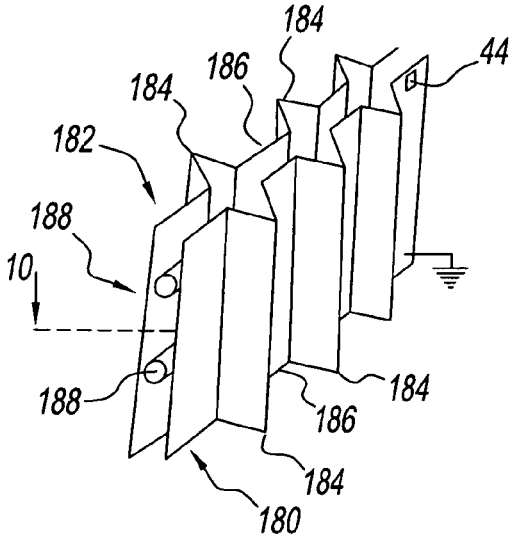
FIGS. 9 and 10 depict another embodiment of the evaporator assembly of the ice making system of FIG. 1.
Figure 10:
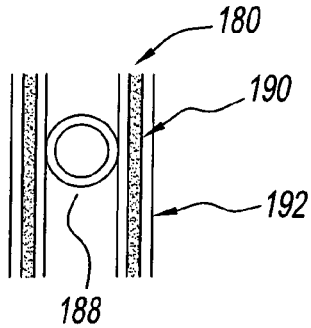

Referring to FIGS. 9 and 10, another embodiment of evaporator assembly 32 comprises a plate or sheet 180 and a plate or sheet 182. Plates 180 and 182 are folded to provide a plurality of corrugations 184 separated by flat portions 186. Plates 180 and 182 may be constructed of stainless steel, or other suitable metal. A refrigerant tube 188 is disposed between plates 180 and 182 and is bonded to flat portions 182.

Referring to FIG. 10, plate 180 is covered or coated with a thin dielectric and electrically insulating layer 190, which in turn is covered by a thin electrically conductive layer (e.g., a metallic foil) 192 (e.g., such as stainless steel) similar to foils 110 and 112 (FIG. 7). A thin dielectric and insulating layer and a foil similarly cover plate 182.

Controller 38 controls cooling system 36 to supply refrigerant to refrigerant tube 188 during a freezing mode to cool plates 180 and 182 and foils 192 to a suitable temperature (below 0° C.) for forming ice pieces thereon. Controller 38 also during the freezing mode controls water supply 34 to provide water to a water distributor (not shown) that provides water to flow over thin electrically conductive layers 192. Controller 38 continues the freeze mode until the ice pieces form on foils 192.

Controller 38 then initiates a harvest mode by operating electrical energy source 42 to apply short duration electrical energy to foils 192 via contacts 44 and circuit ground. This results in heating, which causes the ice to melt free of foils 192 and to fall into ice bin 40.

Figure 11:
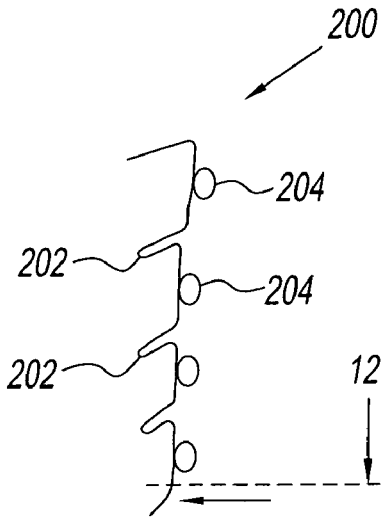
FIGS. 11 and 12 depict another embodiment of the evaporator assembly of the ice making system of FIG. 1.
Figure 12:
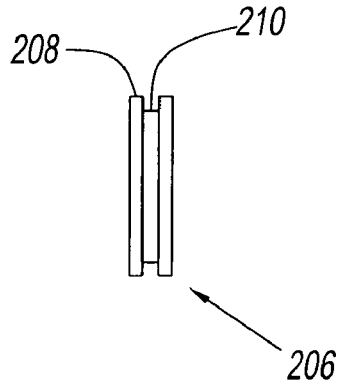

Referring to FIG. 11 and 12, another embodiment of evaporator assembly 32 comprises a waffle style pan 200 having a plurality of horizontal rows of ice forming surfaces 202. Ice forming surfaces 202 have a slight downward slope upon which ice pieces are formed during a freezing mode. A refrigerant tube 204 is bonded to a back surface of pan 200 having horizontal runs in the vicinity of the downward slopes. Optionally, another pan (not shown) identical to pan 200 could have its back side bonded to the opposite side of refrigerant tube 204. Pan 200 is preferably metallic (e.g., nickel plated copper, aluminum, stainless steel, etc.) but can be thermally conductive plastic.

As depicted in FIG. 12, pan 200 is constructed in sandwich style of metallic layers 206 and 208 with a dielectric layer 210 disposed in-between. In a preferred embodiment, metallic layers 206 and 208 are copper and refrigerant tube 204 is copper. This advantageously allows copper layer 206 to be soldered to a copper refrigerant tube 204. The entire assembly is then nickel plated.

Contact 44 is also soldered to pan 200 and circuit ground is connected to pan at a point spaced from contact 44.

Controller 38 controls cooling system 36 to supply refrigerant to refrigerant tube 204 during a freezing mode to cool pan 200 to a suitable temperature (below 0° C.) for forming ice pieces thereon. Controller 38 also during the freezing mode controls water supply 34 to provide water to a water distributor (not shown) that provides water to flow over ice forming surfaces 202 of pan 200. Controller 38 continues the freeze mode until the ice pieces form on ice forming surfaces 202.

Controller 38 then initiates a harvest mode by operating electrical energy source 42 to apply short duration electrical energy to pan 200 via contacts 44 and circuit ground. This results in heating, which causes the ice to melt free of ice forming surfaces 202 and to fall into ice bin 40.

Figure 13:
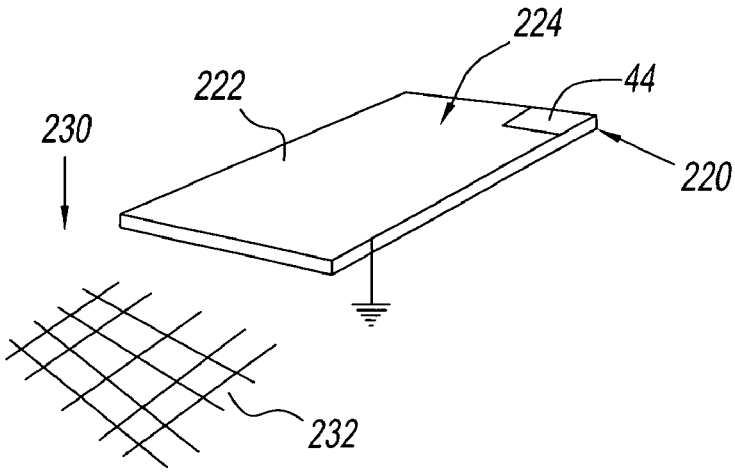
FIG. 13 depicts another embodiment of the evaporator assembly of the ice making system of FIG. 1.

Referring to FIG. 13, another embodiment of evaporator assembly 32 comprises a plate 220 having flat ice forming surface 222, which is slanted or sloped downwardly. Plate 220 has an associated refrigerant tube or passages for cooling with refrigerant. Optionally plate 200 can be cooled with cold air.

Controller 38 controls cooling system 36 to supply refrigerant to the refrigerant tube 204 during a freezing mode to cool plate 220 to a suitable temperature (below 0° C.) for forming ice thereon. Controller 38 also during the freezing mode controls water supply 34 to provide water to a water distributor (not shown) that provides water 224 to flow over ice forming surface 222 of plate 200. Controller 38 continues the freeze mode until a slab of ice forms on ice forming surface 222.

Contact 44 is also soldered to plate 220 and circuit ground is connected to plate 220 at a point spaced from contact 44.

Controller 38 controls cooling system 36 to supply refrigerant to the refrigerant tube during a freezing mode to cool plate 220 to a suitable temperature (below 0° C.) for forming ice pieces thereon. Controller 38 also during the freezing mode controls water supply 34 to provide water to a water distributor (not shown) that provides water 224 to flow over ice forming surface 222 of plate 220. Controller 38 continues the freeze mode until the ice slab of a predetermined thickness forms on ice forming surface 222.

Controller 38 then initiates a harvest mode by operating electrical energy source 42 to apply short duration electrical energy to plate 220 via contact 44 and circuit ground. This results in heating, which causes the ice to melt free of ice forming surfaces 222 and to fall onto a post harvest ice processor 230. Ice processor 230 comprises a wire grid 232. The ice slab after release from plate 220 comes to rest on the wire grid 232. The ice slab melts into cubes as it passes through wire grid 232. The ice cubes fall into ice bin 40.

Figure 14:
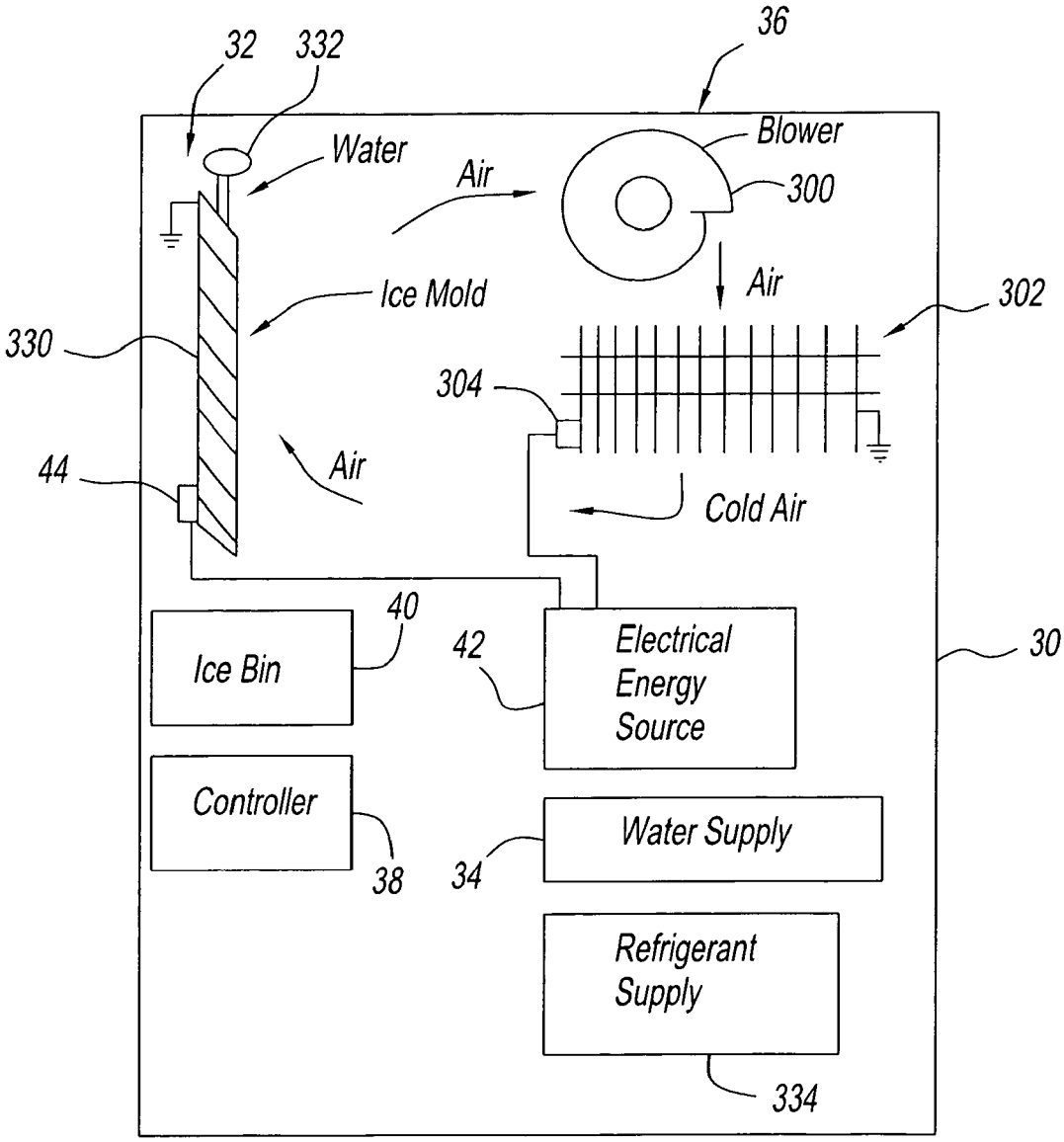
FIG. 14 depicts the ice making system of FIG. 1 using an air cooling system.

Referring to FIG. 14, ice making machine 30 is depicted with a cooling system 36 that uses cold air to cool ice forming assembly (or ice mold) 32 and water that flows over it to form ice thereon, which is harvested using PETD harvest technology. Air cooling system 36 comprises a blower 300, an evaporator 302, a refrigerant supply 334 and ductwork (not shown). The ductwork is arranged to provide a circulation path for air from blower 300, through evaporator 302, through delivery ductwork to ice forming assembly 32 and through return ductwork to blower 300.

Ice forming assembly 32 comprises a waffle style pan 330 that is modified for use of PETD harvesting. For example, the pan of ice forming assembly 32 can be the pan of FIG. 11 without the refrigerant tube. Contact 44 and circuit ground are shown affixed to the pan of shown. Ice forming assembly 32 comprises a water distributor 332 that provides water to flow over the ice forming surfaces of pan 330. It will be apparent to those skilled in the art that other ice forming assemblies equipped for PETD harvest, including the ones described above, can be used.

Evaporator 302 is preferably an evaporator coil through which refrigerant from refrigerant supply 334 is circulated. Evaporator 302 has a circuit ground connection and an electrical contact 304 that are connected to electrical energy source 42.

Controller 38 during the freeze mode causes water supply 34 to supply water to water distributor 332 that distributes the water to flow over the ice forming surfaces of pan 330. Controller 38 also operates a refrigerant supply (not shown) of cooling system 36 to supply refrigerant to evaporator coil 302. Controller 38 further operates blower 300 to circulate air through evaporator 302, the delivery ductwork, the ice forming surfaces of ice forming assembly 32 and the return ductwork to blower 300. Evaporator 302 acts to cool the circulating air to a temperature (below 0° C.) that causes the water flowing over the ice forming surfaces in ice forming assembly 32 to freeze and form ice pieces thereon.

The circulating cold air freezes the flowing water on the outside of the forming ice cubes somewhat akin to the formation of icicles wherein cold air freezes water on the outside of the icicle. This is a more efficient method compared to prior art ice making machines that rely on heat transfer through the ice layer, ice being a poor thermal conductor, to grow the ice cubes.

Controller 38 begins a harvest mode when the freezing mode is completed (e.g., the ice cubes reach a predetermined thickness). The controller turns off water supply 34 and blower 300. Controller 38 operates electrical energy source 42 to provide a short duration PETD pulse or pulses to ice forming assembly 32 via contact 44 and circuit ground. The ice cubes melt and become free of the ice forming surfaces and fall into ice bin 40.

Moisture picked up by the circulating cold air during the freeze mode can freeze onto evaporator 302. Controller 38 operates electrical energy source 42 to apply a short duration PETD pulse or pulses to ice forming assembly 32 via contact 304 and circuit ground to efficiently and quickly defrost evaporator 302. Because the defrost is so quick, it can be done at frequent intervals (e.g., every 10 minutes) without serious disruption of the freeze and harvest modes.

The air cooling system allows the ice molds or pans to be made from non-metallic, non-thermally conductive and less costly materials since the pans themselves do not need to conduct heat. Also, refrigerant tubes do not need to be attached to the pans. Also, air cooling evaporators are inexpensive. The net result is a gain in heat transfer efficiency at low cost.

The present invention having been thus described with particular reference to the preferred forms thereof, it will be obvious that various changes and modifications may be made therein without departing from the spirit and scope of the present invention as defined in the appended claims.

What is claimed is:

1. An ice making machine comprising:

a water supply, a cooling system, an electrical energy source, and an evaporator assembly, wherein said evaporator assembly comprises at least one thermally conductive surface disposed in thermal transfer with an electrically conductive and thermally conductive layer, and wherein said layer is connected in circuit with said electrical energy source; and a controller that during a freeze mode operates said water supply and said cooling system to form ice on said electrically conductive and thermally conductive layer and during a harvest mode operates said electrical energy source to apply electrical pulse energy to said electrically conductive and thermally conductive layer to melt an interfacial layer of said ice such that it is freed from said layer, wherein said electrically conductive and thermally conductive layer is part of an array of thermally conductive surfaces, wherein said evaporator assembly further comprises a base portion that includes said array of thermally conductive surfaces, and wherein said thermally conductive surfaces are separated from one another by spaces over which ice is not formed during said freeze mode.

2. The ice making system of claim 1, wherein said electrically conductive and thermally conductive layer is made of a material selected from the group consisting of: aluminum, steel, copper and thermally conductive plastic.

3. The ice making system of claim 1, wherein said electrically conductive and thermally conductive layer is a foil.

4. The ice making system of claim 1, wherein said freed ice comprises a plurality of thin ice layers, wherein said evaporator assembly further comprises a laminator that combines said ice layers into a laminated ice piece.

5. The ice making machine of claim 1, wherein said spaces are occupied by a substance selected from the group consisting of: air and a thermally insulating material.

6. The ice making system of claim 1, wherein said base portion comprises a plate that includes a plurality of raised portions that extend in rows across said plate and at least one layer of poor thermal conductivity that extends over said rows to occupy said spaces.

7. The ice making system of claim 6, wherein said raised portions comprise raised freeze sites that form said array of surfaces.

8. The ice making system of claim 7, wherein said array of thermally conductive surfaces is disposed on triangular shaped ridges of said raised portions.

9. The ice making system of claim 1, wherein said evaporator assembly further comprises a base portion that includes a plurality of corrugations interleaved with flat portions that form said array of thermally conductive surfaces.

10. The ice making system of claim 1, wherein a layer of dielectric material is disposed between said base portion and said electrically conductive and thermally conductive layer.

11. The ice making system of claim 1, wherein said base portion is configured as a pan.

12. The ice making system of claim 1, wherein said thermally conductive surface is substantially flat, wherein said ice is formed as a slab, and wherein said freed slab of ice is partitioned into smaller pieces of ice.

13. The ice making system of claim 12, wherein said evaporator assembly further comprises a wire grid that is used to partition said freed slab of ice into said pieces of ice.

14. The ice making system of claim 1, wherein said cooling system is selected from the group consisting of: refrigerant and cool air.

15. An ice making system comprising:

a water supply, a cooling system, an electrical energy source, and a vertical ice forming assembly, wherein said vertical ice forming assembly comprises at least one thermally conductive surface disposed in thermal transfer with an electrically conductive and thermally conductive layer, and wherein said layer is connected in circuit with said electrical energy source; and a controller that during a freeze mode operates said water supply and said cooling system to form ice on said electrically conductive and thermally conductive layer and during a harvest mode operates said electrical energy source to apply electrical pulse energy to said electrically conductive and thermally conductive layer to melt and interfacial layer of said ice such that it is freed from said layer, wherein said cooling system comprises a blower, a refrigerant supply and an evaporator; and wherein the controller during the freeze mode operates said blower to provide an air stream that flows to said evaporator assembly and operates said refrigerant supply and said vertical ice forming to cool said air stream to a temperature that causes said ice to form on side electrically conductive and thermally conductive layer.

16. A method of melting ice with an ice making machine that comprises an evaporator assembly that includes at least one thermally conductive surface in thermal transfer with an electrically conductive and thermally conductive layer, a water supply, a cooling system and an electrical energy source, comprising:

during a freeze mode operating said water supply and said cooling system to form ice on said electrically conductive and thermally conductive layer; and during a harvest mode operating said electrical energy source to apply electrical pulse energy to said electrically conductive and thermally conductive layer to melt an interfacial layer of said ice such that it is free from said electrically conductive and thermally conductive layer, wherein said electrically conductive and thermally conductive layer is part of an array of thermally conductive surfaces, wherein said evaporator assembly further comprises a base portion that includes said array of thermally conductive surfaces, and wherein said thermally conductive surfaces are separated from one another by spaces over which ice is not formed during said freeze mode.

17. The method of claim 16, wherein said freed ice comprises a plurality of thin layers, and further comprising laminating said thin ice layers into a laminated ice piece.

18. The method of claim 16, wherein said thermally conductive surface is part of an array of thermally conductive surfaces in thermal transfer with said electrically conductive and thermally conductive layer, wherein said evaporator assembly further includes a plate that includes a plurality of raised portions that extend in rows across said plate and at least one layer of poor thermal conductivity that extends over said rows to partition said rows into said array of thermally conductive surfaces.

19. The method of claim 16, wherein said thermally conductive surface is part of an array of thermally conductive surfaces in thermal transfer with said electrically conductive and thermally conductive layer, wherein said evaporator assembly further comprises a plate that includes a plurality of corrugations interleaved with flat portions that form said array of thermally conductive surfaces.

20. The method of claim 16, wherein said thermally conductive surface is part of an array of thermally conductive surfaces in thermal transfer with said electrically conductive and thermally conductive layer, wherein said evaporator assembly further comprises a pan.

21. The method of claim 16, wherein said thermally conductive surface is substantially flat and ice is formed thereon is a slab, and further comprising partitioning said slab of ice, when freed from said electrically conductive and thermally conductive layer, into a plurality of smaller pieces of ice.

* * * * *